US007395950B2

(12) United States Patent
Ropp

(10) Patent No.: US 7,395,950 B2
(45) Date of Patent: Jul. 8, 2008

(54) COMBINED THREAD SPOOL, NEEDLE HOLDER AND THREAD CUTTER

(76) Inventor: Gayle P. Ropp, 504-B N. Thomas St., Arlington, VA (US) 22203

( * ) Notice: Subject to any disclaimer, the term of this patent is extended or adjusted under 35 U.S.C. 154(b) by 292 days.

(21) Appl. No.: 11/223,036

(22) Filed: Sep. 12, 2005

(65) Prior Publication Data

US 2007/0057110 A1 Mar. 15, 2007

(51) Int. Cl.
*A41H 31/00* (2006.01)
*B65H 49/00* (2006.01)

(52) U.S. Cl. ..... 223/106

(58) Field of Classification Search ..... 223/106–109 A; 224/576; 242/170, 171, 596, 125
See application file for complete search history.

(56) References Cited

U.S. PATENT DOCUMENTS

| | | | | | |
|---|---|---|---|---|---|
| 73,825 | A | | 1/1868 | Myrick | |
| 255,745 | A | * | 3/1882 | Williams | 225/61 |
| 377,436 | A | | 2/1888 | Purcell | |
| 431,347 | A | | 7/1890 | Gore | |
| 556,592 | A | | 3/1896 | Tracheel | |
| 601,321 | A | | 3/1898 | Herrschaft | |
| 632,686 | A | | 9/1899 | Bingaman | |
| 690,400 | A | * | 1/1902 | Cordes | 225/59 |
| 698,295 | A | * | 4/1902 | Koller | 223/108 |
| 790,003 | A | | 5/1905 | Ritzenthaler | |
| 908,292 | A | | 12/1908 | Mann | |
| 1,554,214 | A | * | 9/1925 | Hoffmann | 223/109 R |
| 1,593,775 | A | | 7/1926 | Privracky | |
| D93,378 | S | | 9/1934 | Abrone | |
| 1,997,426 | A | * | 4/1935 | Morse et al. | 242/137.1 |
| 2,037,628 | A | * | 4/1936 | Hogarth | 223/109 R |
| 2,044,207 | A | * | 6/1936 | Chaffin | 242/137.1 |
| D110,766 | S | | 8/1938 | Graff | |
| 2,195,316 | A | * | 3/1940 | Marick et al. | 223/109 R |
| D123,239 | S | | 10/1940 | Askowski | |
| 2,223,248 | A | * | 11/1940 | Frisk et al. | 223/109 R |
| 2,413,800 | A | * | 1/1947 | Swift | 224/201 |
| 2,579,307 | A | * | 12/1951 | Dillemuth | 223/106 |
| 2,654,513 | A | * | 10/1953 | Spencer | 223/109 R |
| 3,009,611 | A | * | 11/1961 | Bates | 223/106 |
| D252,396 | S | | 7/1979 | Gros | |
| D284,331 | S | | 6/1986 | O'Toole | |
| 4,998,685 | A | * | 3/1991 | Spencer | 242/137 |
| 5,913,485 | A | | 6/1999 | Bruffett | |
| D486,958 | S | | 2/2004 | Sauber | |
| D492,105 | S | | 6/2004 | Sauber | |

* cited by examiner

*Primary Examiner*—Ismael Izaguirre
(74) *Attorney, Agent, or Firm*—Clark & Brody

(57) ABSTRACT

A thread spool holder comprises an elongate shaft, for receiving a spool of thread, with a flange at one end for engaging one end of the spool. A thread cutter is provided at one end of the shaft allowing the user to cut thread easily. The shaft is hollow to form an elongate cavity and closed by a removable cap. When the cap is removed the user may have access to the cavity for storing needles.

7 Claims, 2 Drawing Sheets

FIG. 2
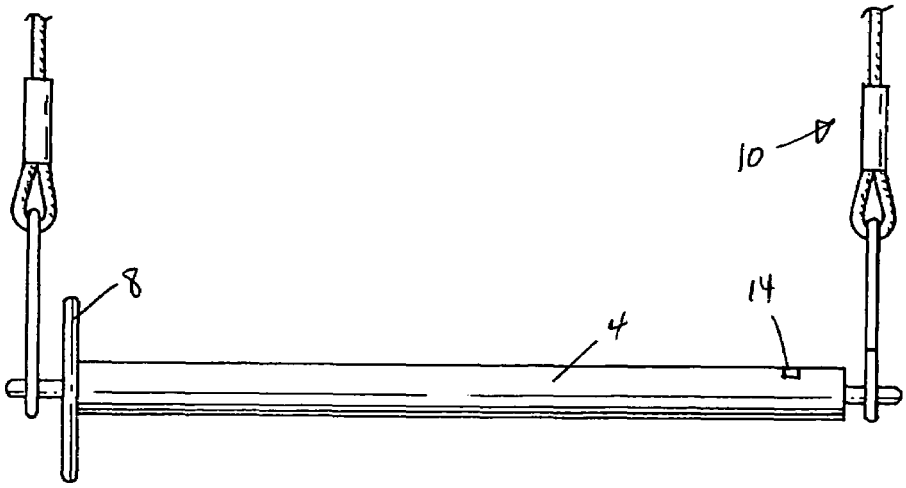
FIG. 3
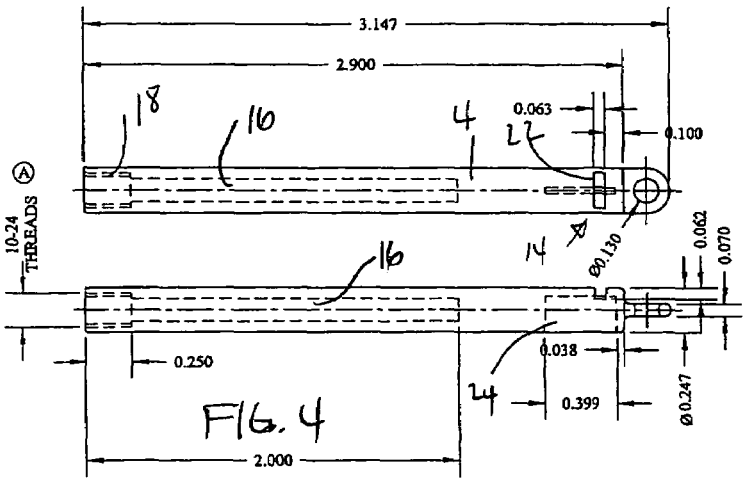
FIG. 4
FIG. 5
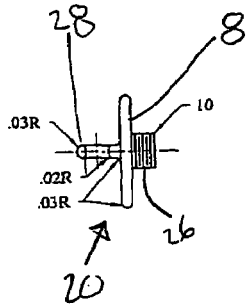

COMBINED THREAD SPOOL, NEEDLE HOLDER AND THREAD CUTTER

TECHNICAL FIELD

This invention relates to the art of devices used by seamstresses, quilters and the like for holding a spool of thread. In particular, the invention relates to a device for proving, in a readily accessible location, a spool of thread, a needle, and a thread cutter.

BACKGROUND ART

It is known to support a spool of thread on the person of a quilter, for example, so that the thread is readily available for use. Known devices for supporting a spool of thread provide an axle supported on the neck of a quilter by a cord that passes around the quilter's neck.

A problem with known devices of this sort is that the quilter often requires additional items, such as needles, which may not be readily available. Further, the quilter regularly cuts the thread used for sewing, and it is therefore necessary that a cutting instrument, such as a knife or pair of scissors also be readily available.

SUMMARY OF THE INVENTION

In accordance with the invention, a combined thread spool, needle, and thread cutter comprises an elongate, hollow shaft uniquely configured to support a spool of thread, store one or more needles, and safely present a sharp edge for cutting thread. In the preferred embodiment, the shaft employs a flange at one end for engaging the spool of thread and an eye at the opposite end for receiving a clip on a cord designed to pass around the user's neck. The shaft includes a cavity that is closed at one end but open at the other end to allow needles to be placed in the cavity and removed for use. At one end, the shaft includes a recess that receives a sharp instrument that acts as a thread cutter. The recess is located at a position on the shaft that would ordinarily be located beyond the end of the thread spool so that the thread cutter may be used while the spool is held in an operating position on the shaft.

The cavity is preferably accessed by providing a removable cap on the open end of the shaft. The removable cap closes the opening to retain the needles in the cavity and is easily removed to allow insertion or removal of needles. In the preferred embodiment, the removable cap is integral with the flange whereby the flange facilitates grasping of the cap. The cap may, however, be placed on the opposite end of the shaft. In the preferred embodiment, the cap is threaded. The cap need not, however, be threaded but, instead, may be attached in any number of ways, such as by a bayonet connection, a rubber-stopper type connection, and the like.

The thread cutter preferably includes a knife-like element received in a radial slot in the shaft such that at least a portion of the element extends into a recess in the shaft. The recess is preferably a notch having a width several times the thickness of thread normally used by quilters extending transverse to the axis of the shaft whereby the thread is cut by placing it in the recess and pulling it against the knife-like element.

BRIEF DESCRIPTION OF THE DRAWING FIGURES

FIG. 2 is a partial front view of the spool holder shown in FIG. 1.

FIG. 3 is a side view of a shaft portion of the spool holder of FIG. 1.

FIG. 4 is a front view of the shaft portion shown in FIG. 3

FIG. 5 is a front view of a flange portion of the spool holder of FIG. 1.

DETAILED DESCRIPTION OF THE PREFERRED EMBODIMENT

Figure 1:
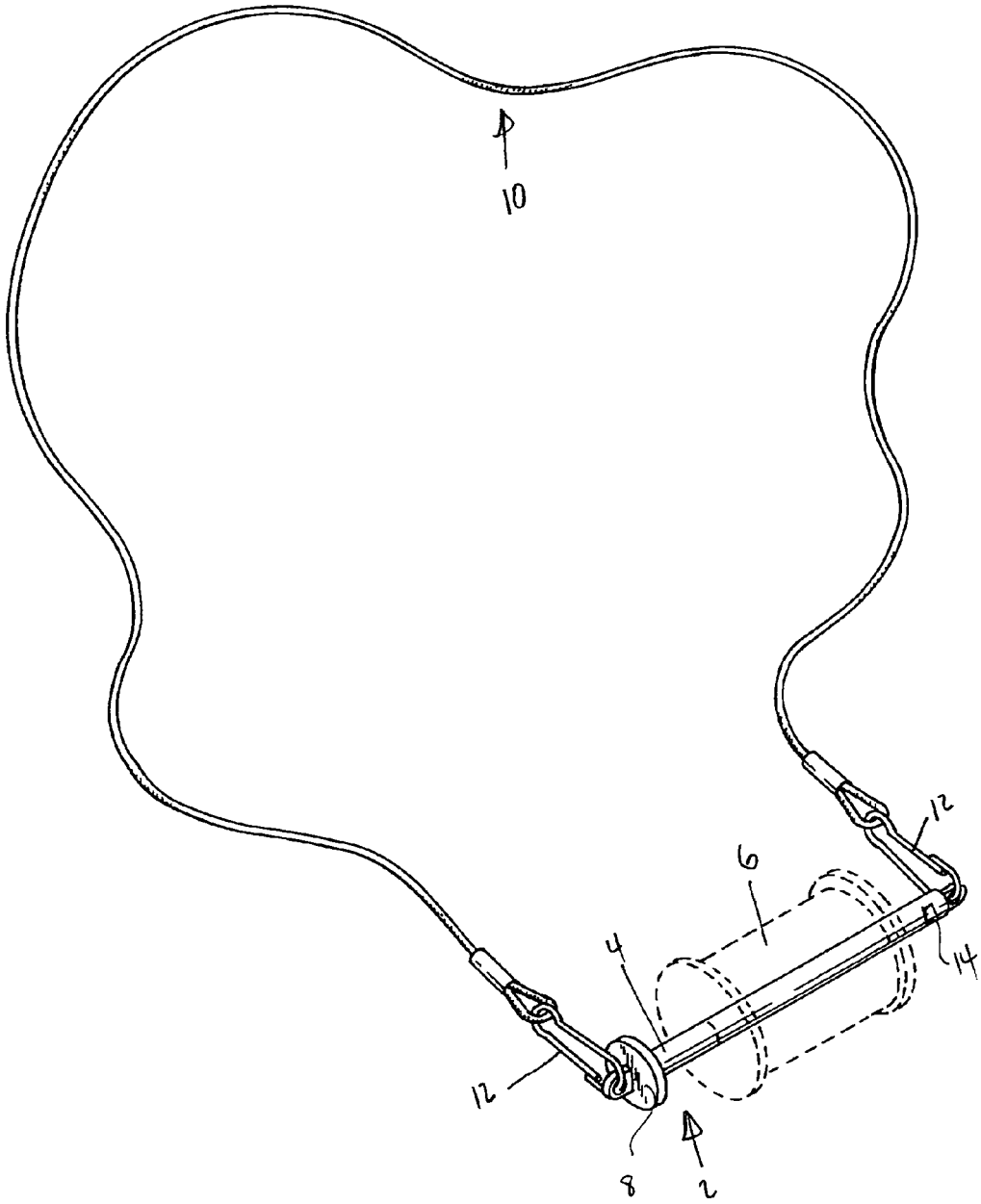
FIG. 1 is a perspective view of a thread spool holder in accordance with the invention.

With reference to FIGS. 1 and 2 of the drawings, a spool holder 2 in accordance with the invention includes an elongate shaft 4 that is configured to receive a spool of thread 6. The shaft has a flange 8 at one end for engaging an end of the spool of thread and supporting it as the spool rotates during removal of thread from the spool. The shaft is preferably supported on a user's chest by a necklace 10, which is attached to opposite ends of the shaft by clips 12. The clips 12 engage eyes in the ends of the shaft, but it will be appreciated that other mechanisms for detachably securing the ends of the necklace to the ends of the shaft may be used.

The shaft includes a thread cutter 14 near one end for conveniently cutting thread.

The preferred embodiment of the shaft 4 will now be described with reference to FIGS. 3 and 4. The shaft 4 is provided with an elongate cavity 16, which extends along a portion of the shaft for receiving needles (not shown). One end of the shaft 16 is open to allow the needles to be placed in the cavity for storage or removed for use. The open end may be selectively closed by attaching a cap 20 (see FIG. 5) thereto. As will be explained below, the cap in the preferred embodiment includes the flange 8 at one end and threads 26 at the other end to engage cooperating threads 18 in the cavity 16.

Providing the flange portion of the spool holder on the removable cap portion allows the user to grasp and manipulate the removable end more easily.

The construction of the thread cutter feature of the spool holder according to the invention is shown in FIGS. 3 and 4. The shaft 4 is provided with a thread guide 22, which in the preferred embodiment is a recess, or groove, extending transverse to the longitudinal axis of the shaft. The thread guide is wide enough to receive one or several courses of the thread and to guide the thread to a cutting knife 24. The cutting knife 24 is preferably a small, flat piece of material with a sharp upper edge. The shaft 24 is provided with a radial slot the shape of the knife 24 and extending into the thread guide 24 by a small distance whereby the knife extends into the guide 24 by the small distance. Thus, with reference to FIG. 4, during manufacture knife 24 is inserted into the radial slot from the bottom of the shaft (as viewed in FIG. 4) so that a small portion of the upper edge protrudes into the groove forming thread guide 24.

FIG. 5 illustrates a preferred embodiment of the end cap 20. The cap includes the flange 8 as described, a threaded portion 26 that cooperates with threads 18 to secure the cap to the shaft, and an eye 28 for receiving one end of the necklace 10.

In use, a user may easily remove thread from a spool, use it during sewing, and then cut the thread by placing the thread in the guide 24 and applying the sharp edge to the thread. Modifications within the scope of the appended claims will be apparent to those of skill in the art.

I claim:

1. A thread spool holder comprising an elongate tubular shaft having an outside diameter whereby it can be inserted in said thread spool and having a portion forming a cavity for storing one or more needles, a flange at one end of said shaft, an outside diameter of said flange being larger than said outside diameter of said shaft, a cap for removable attachment to said portion, said cap closing said cavity when attached to said portion and allowing access to said cavity when detached from said portion, and a thread cutter near one end of said shaft, said thread cutter comprising a thread guide in an exterior surface of said shaft and a sharp edge recessed in said thread guide.

2. A thread spool holder according to claim 1 wherein said cap comprises said flange.

3. A thread spool holder according to claim 2 wherein said thread cutter further comprises a groove extending transverse to a longitudinal axis of said shaft.

4. A thread spool holder according to claim 3 wherein said sharp edge comprises a flat element having a sharp edge received in a radial slot in said shaft.

5. A thread spool holder according to claim 1 further comprising an eye at each end of said shaft and a necklace engaging each said eye.

6. A thread spool holder according to claim 1 wherein said thread cutter is located at an end of said shaft opposite said flange.

7. A thread spool holder according to claim 5 wherein said necklace includes a clip to engage said eye at each of said shaft.

* * * * *